US007485058B1

(12) United States Patent
Payne et al.

(10) Patent No.: US 7,485,058 B1
(45) Date of Patent: Feb. 3, 2009

(54) SPORT BALL WITH REMOVABLE OUTER COVER

(75) Inventors: Christopher Lee Payne, Detroit, MI (US); Tyrone William Johnnie Jones, Detroit, MI (US)

(73) Assignee: Julius Galvon, Lincoln Park, MI (US), part interest ( * ) Notice: Subject to any disclaimer, the term of this patent is extended or adjusted under 35 U.S.C. 154(b) by 0 days.

(21) Appl. No.: 11/413,846

(22) Filed: Apr. 29, 2006

(51) Int. Cl.
*A63B 41/08* (2006.01)

(52) U.S. Cl. ..... 473/607; 473/574; 473/573; 473/608

(58) Field of Classification Search ..... 473/423–430, 473/598, 599, 607, 608, 573–576, 594; 273/156; 206/315.9
See application file for complete search history.

(56) References Cited

U.S. PATENT DOCUMENTS 1,699,666 A * 1/1929 Koegel ..... 473/599
1,988,722 A * 1/1935 De Beer ..... 473/598
3,032,345 A * 5/1962 Lemelson ..... 473/280
3,927,881 A * 12/1975 Lemelson et al. ..... 473/573
4,053,156 A * 10/1977 Bai ..... 473/573
5,123,869 A * 6/1992 Schipmann ..... 446/46
5,611,541 A * 3/1997 Paino ..... 273/317
5,730,287 A * 3/1998 Martin ..... 206/315.9
5,772,542 A * 6/1998 Gildea et al. ..... 473/576
6,030,303 A * 2/2000 Wallace, Jr. ..... 473/575
6,398,677 B1 * 6/2002 Hergert et al. ..... 473/599
6,991,553 B2 * 1/2006 Park et al. ..... 473/219
7,077,769 B2 * 7/2006 Buschfort ..... 473/570

* cited by examiner

*Primary Examiner*—Steven Wong
(74) *Attorney, Agent, or Firm*—Steve M Clemmons

(57) ABSTRACT

A sports ball, such as a basketball, is provided that allows a user to remove the outer shell of the ball from the inner carcass of the ball. Attachment means removably couple the shell to the carcass. The attachment means are disposed on the shell and carcass and can comprise at least one of the following: a layer of hook-and-loop fastener material, a plurality of snap fasteners, a plug and cooperating retention aperture, and a series of interlocking tongue-and-groove style fasteners.

12 Claims, 8 Drawing Sheets

SPORT BALL WITH REMOVABLE OUTER COVER

FIELD OF THE INVENTION

This invention is related to ball sport projectiles and more particularly to inflatable sports balls.

BACKGROUND OF THE INVENTION

The broad purpose of the present invention is to provide an improved sports ball, such as a basketball, that allows a user to readily replace the outer cover of the ball when it has become worn and/or to customize the appearance of the ball.

Currently, basketballs are constructed with an inflatable rubber bladder that is permanently bonded to an outer cover. The cover includes a plurality of panel sections having an exterior surface that is leather, synthetic leather, or rubber.

Further, each panel section is separated by a rubber channel or seam which tends to give the basketball a lobed or lobular appearance. These seams provide a user with additional grip on the ball.

The exterior surface of a conventional ball tends to wear down during extended play, particularly on outdoor courts. This undesirably causes the ball to become too slippery for satisfactory play. Once the outer surface of a conventional basketball becomes worn, the ball must be discarded and an entire new ball must be purchased.

Additionally, the ever-growing trend of customization of everyday products (e.g., clothing, automobiles, and wireless telephone casings) cannot be adequately addressed by conventional sports balls as these balls are provided as a single unit. The mass-production of such products precludes a user from adding uniqueness or style to any one ball beyond marking the exterior surface of the ball with hand-drawn lettering or pictures. Customization also allows users to easily identify which ball belongs to him when playing on a court or playground with a number of other players that may have each brought their own ball.

Furthermore, different playing conditions often determine which type of ball is used. If playing in a gymnasium a "regulation" leather ball is normally used, while playing outdoors on concrete normally calls for a rubber or synthetic-leather ball. A player will often have to bring two or three conventional balls of different exterior materials with him if he does not know what the playing conditions will be.

Therefore, a need exists to provide a sports ball, such as a basketball, that will allow a user to customize the appearance of an individual ball and to replace the exterior surface of the ball when the ball becomes worm, damaged, or to best fit the playing conditions.

SUMMARY OF THE INVENTION

The preferred embodiment of the invention includes a carcass or inner ball that has an inflatable bladder and a removable outer shell or cover. The inner ball has an outer surface that has attachment means for removably coupling the shell to the inner ball. The exterior surface of the shell replicates the look and feel of a conventional ball.

Once the exterior surface has become worn, the user can remove the worn shell and replace it with a new shell. Additional shells of different color or stylization may be brought to a gym or park to ensure that a player can easily identify his ball. Similarly, the shells may be made from different exterior surface materials to allow a user to choose the appropriate ball-type dependent on the playing conditions. In this way, a player only has to bring one relatively large and cumbersome ball while being able to quickly customize the ball to the playing environment by bringing additional flat, portable, and lightweight shells.

Still further objects and advantages of the invention will become readily apparently to those skilled in the art to which the invention pertains, upon reference to the following detailed description.

BRIEF DESCRIPTION OF THE DRAWINGS

The description refers to the accompanying drawings in which like reference characters refer to like parts throughout the several views and in which.

DETAILED DESCRIPTION OF THE INVENTION

Figure 1:
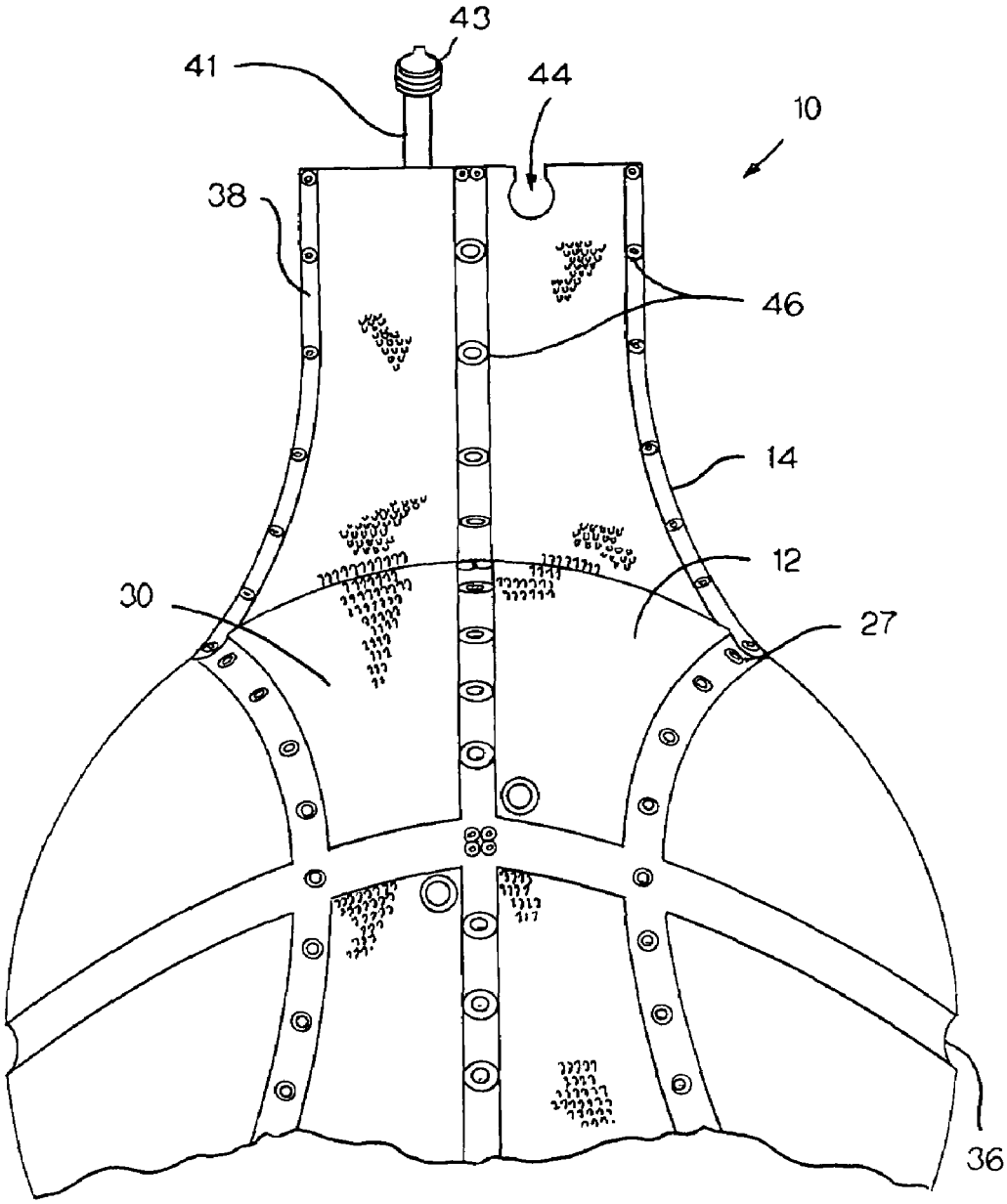
FIG. 1 is a partial perspective view of a basketball illustrating the preferred embodiment of the invention.
Figure 2:
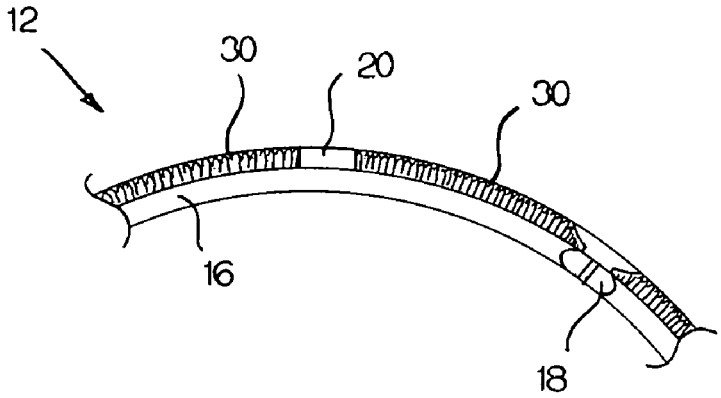
FIG. 2 is a partial side sectional view of the inner ball.
Figure 3:
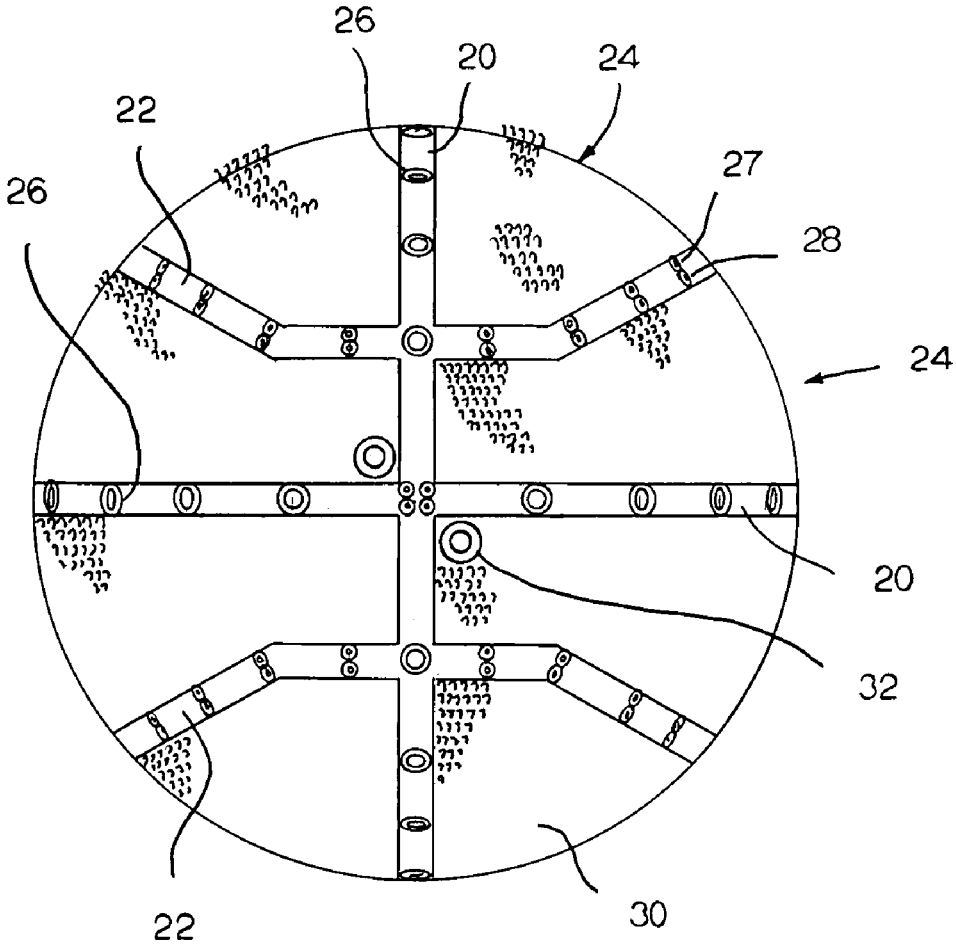
FIG. 3 is a front view of the inner ball.

Referring to the drawings, FIGS. 1-3 illustrate a preferred sports ball 10. In this embodiment, ball 10 is a basketball and includes an inner ball or carcass 12 and an outer shell 14.

Inner ball 12 includes an inflatable bladder 16. Bladder 16 is made from a resilient and air-tight material such as rubber and includes a conventional inflation valve 18.

A number of ridges or seams are disposed around the outer surface of the inner ball 12. The seams include two primary seams 20 and two secondary seams 22. Seams 20 divide the ball 12 into four equal-sized quarter sections. Seams 22 further divide each of these quarter sections into two generally equal sized sections. In this manner, the inner ball 12 is divided into eight distinct sections 24. In the preferred embodiment, the sections 24 and seams 20, 22 are arranged so that inner ball 12 resembles a traditional basketball's pattern. The seams 20, 22 project orthogonally from the inner ball's surface and may be integrally formed with the bladder 16 or may be fixed to the ball 12 through conventional process, such as thermal bonding or adhesives.

In one embodiment of the invention, the seams 20, 22 include a plurality of fasteners 26 that are coupled to the seams 20, 22. The fasteners 26 are one-half of an interlocking male and female fastener. In this embodiment, each fastener 26 is a male stud of a traditional snap-type fastener. As shown in FIG. 3, the secondary seams 22 include fasteners 26 having two adjacent male studs 27, 28 projecting therefrom. The two studs 27, 28 are spaced apart across the width of the seam 22. Further, the primary seams 20 include single stud snap fasteners 26, but at one of the intersections of the seams 20, up to four smaller studs may project out from the seams 20.

Each snap fastener 26 is preferably formed from a durable material such as metal, plastic, or rubber.

In the preferred embodiment each section 24 of the inner ball 12 is covered by the hook fastener portion 30 of a traditional hook-and-loop fastener. That is, each portion of the outer surface of the inner ball 12 between the seams 20, 22 has the barbed or "hook" half of a hook-and-loop fastener, such as Velcro®.

Inner ball 12 may also include a pair of retention wells 32 that are formed into the ball 12. These wells 32 are disposed in the corner of two of the sections 24 so that the wells are cater-corner to one another at the intersections of the primary seams 20. Each well 32 is a plug formed into the inner ball 12 and has a generally cylindrical-walled bore formed therein.

Referring now to FIGS. 1, and 4-6, the cover or outer shell 14 is illustrated as a contiguous relatively flat sheet having four leaves 34. Leaves 34 extend away from each other and give shell 14 a generally X-shaped appearance when lying flat. The shape of the interconnected leaves 34 is such that when the shell 14 is wrapped around a generally spherical object, such as inner ball 12, the shell 14 abuts the outer surface of the inner ball 12 and completely covers the inner ball 12 and conforms to the shape of the inner ball, in the basketball embodiment, the shell 14 takes a spherical shape. The inner ball 12 and shell 14 are preferably sized to cause the outer diameter of the shell 14 (while encasing inner ball 12) to be equal to a conventional basketball.

Figure 4:
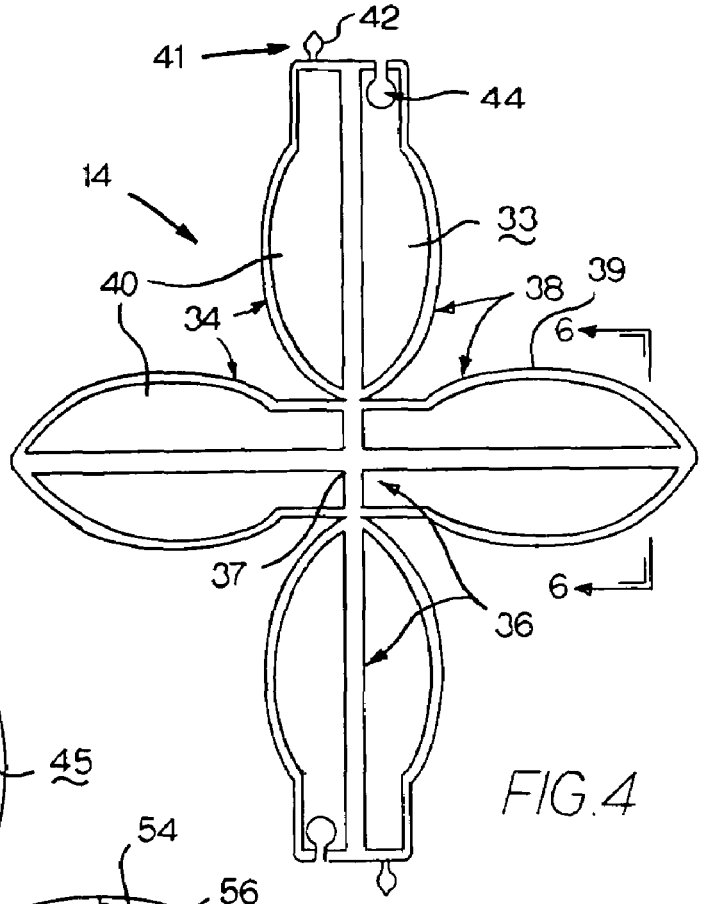
FIG. 4 is a plan view of the outer surface of the cover.

FIG. 4 shows the outer surface 33 of the shell 14. As shown, the four leaves 34 are divided by two primary exterior seams 36 that run across the shell 14. Seams 36 are perpendicular to each other and intersect at the center-most point 37 of the shell 14. The seams 36 are formed of a rubber material and have a width equal to the seams of a regulation basketball.

A split-seam 38 defines the periphery 39 of the outer surface 33. The split-seam 38 is formed from the same material as seam 36 and is approximately one-half the width of the regulation-sized seam 36. As shown best in FIG. 1, when the shell 14 is wrapped around inner ball 12, the split-seams 38 of adjacent leaves 34 abut and cooperatively form a regulation-sized basketball seam.

The remainder of the outer surface 33 of shell 14 is covered by panels 40 of traditional cover material. These panels 40 are disposed between the seams 36, 38 and extend radially (i.e., from the center of the ball 10 when the shell 14 is wrapped around the carcass 12) beyond the seams 36, 38 thereby giving the ball 10 a traditional lobed basketball shape.

Each panel 40 is formed from a leather, synthetic-leather, or rubber material and is permanently bonded to a substrate layer 42 through a conventional process, such as thermal bonding or adhesives. Layer 42 is formed from a flexible material such as rubber.

Additionally, two opposing leaves 34 have additional fastening means for interconnecting these leaves together. In the preferred embodiment each of these leaves includes a tab member 41 that projects from the end of the leaf 34 and terminates in a circular end 42. Coupled to the underside of end 42 is a cylindrical plug 43 that extends away from the outer surface 33. The plug 43 is sized to be frictionally fitted within the bore formed in retention well 32.

Further, each of the leaves 34 having a tab 41 also includes a tab reception area 44 that is sized to frictionally receive the circular-shaped end 42. That is, each reception area 44 is a portion of the shell 14 that is cut-away from the shell in a shape that is complementary to the shape of tab 41. As shown in FIG. 1, when the shell 14 is wrapped around the inner ball 12, the reception area 44 is axially aligned with the center of well 32 to allow a complementary tab 41 on the opposing leaf 34 and its plug 43 to be frictionally held within the bore.

Figure 5:
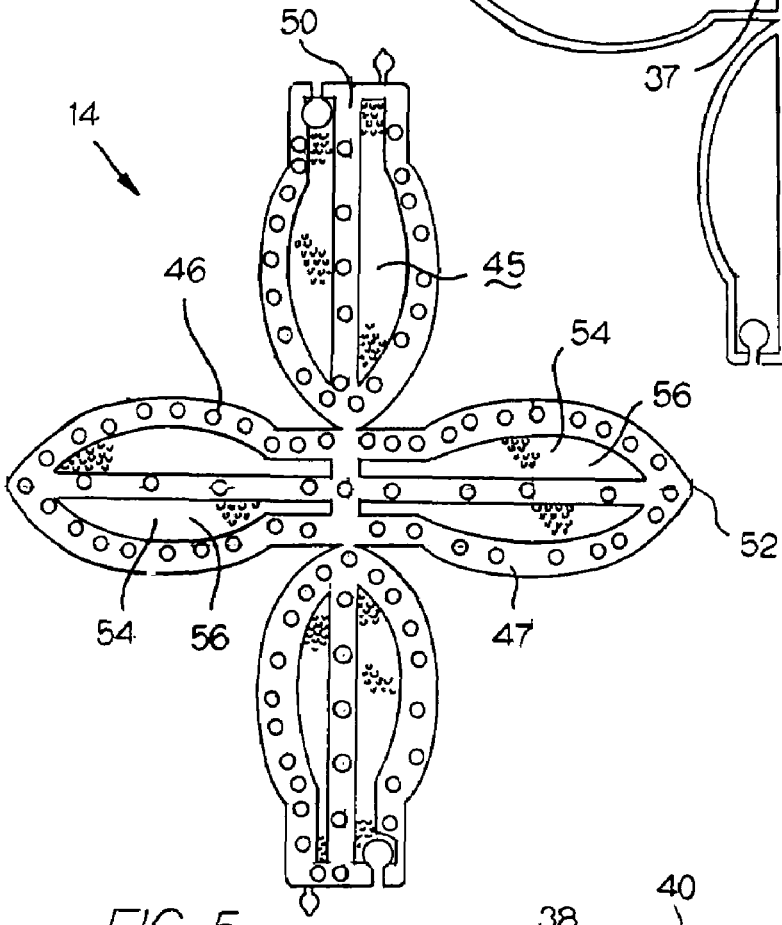
FIG. 5 is a plan view of the inner surface of the cover.
Figure 6:
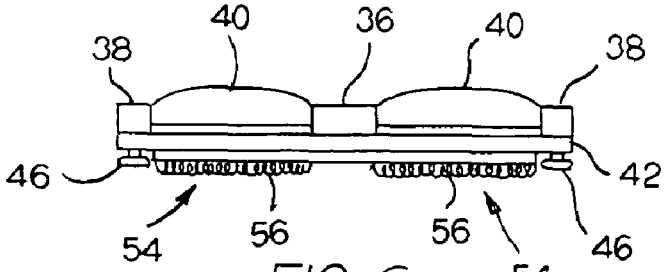
FIG. 6 is a sectional view as seen along lines 6-6 of FIG. 4.

The inner-most surface 45 of the shell 14 is shown best in FIG. 5. The inner surface 45 has a plurality of fasteners 46 that are complementary to fasteners 26 of the inner ball. That is, surface 45 includes a number of female snap fasteners 46 that are arranged in a pattern which matches the pattern of the fasteners 26 around inner ball 12. To match the fastener pattern of the inner ball 12, the fasteners 46 are arranged around the periphery 48 of surface 45 (i.e., the underside of periphery 39) and along two perpendicular axes 50, 52 that each bisect two of the leaves 34.

The fasteners 46 mounted on axes 48, 50 and around the periphery 39 cooperate to define eight sections 54 that are in the same general shape as sections 24 of the inner ball 12. Each section 54 is covered by the loop fastener portion 56 of a traditional hook-and-loop fastener. That is, each portion 54 of the inner surface 45 of the shell 14 has the soft "loop" half of a hook-and-loop fastener, such as Velcro®.

In operation, the shell 14 may be removable coupled to the inner ball 12 by first coupling the complementary fasteners 26, 46 of the center point 37 of the shell 14 to the side of the inner ball 12 opposite to the retention wells 32. Each of the leaves 34 is wrapped around the inner ball 12 while fastening the snaps 26, 46. The adjacent split-seams 38 abut along the secondary seams 22 and one of the pair of fastener studs 27, 28 couples each of one of the abutting leaves 34 to the inner ball. The complementary hook-and-loop fastener portions 30, 56 and the fasteners 26, 46 couple the shell 14 to the inner ball 12. Lastly, the retention areas 44 are axially aligned with the retention wells 32 and the plugs 43 are inserted into the cooperating wells 32. Removal of the shell 14 from the inner ball 12 is accomplished by performing the above steps in reverse order.

Figure 7:
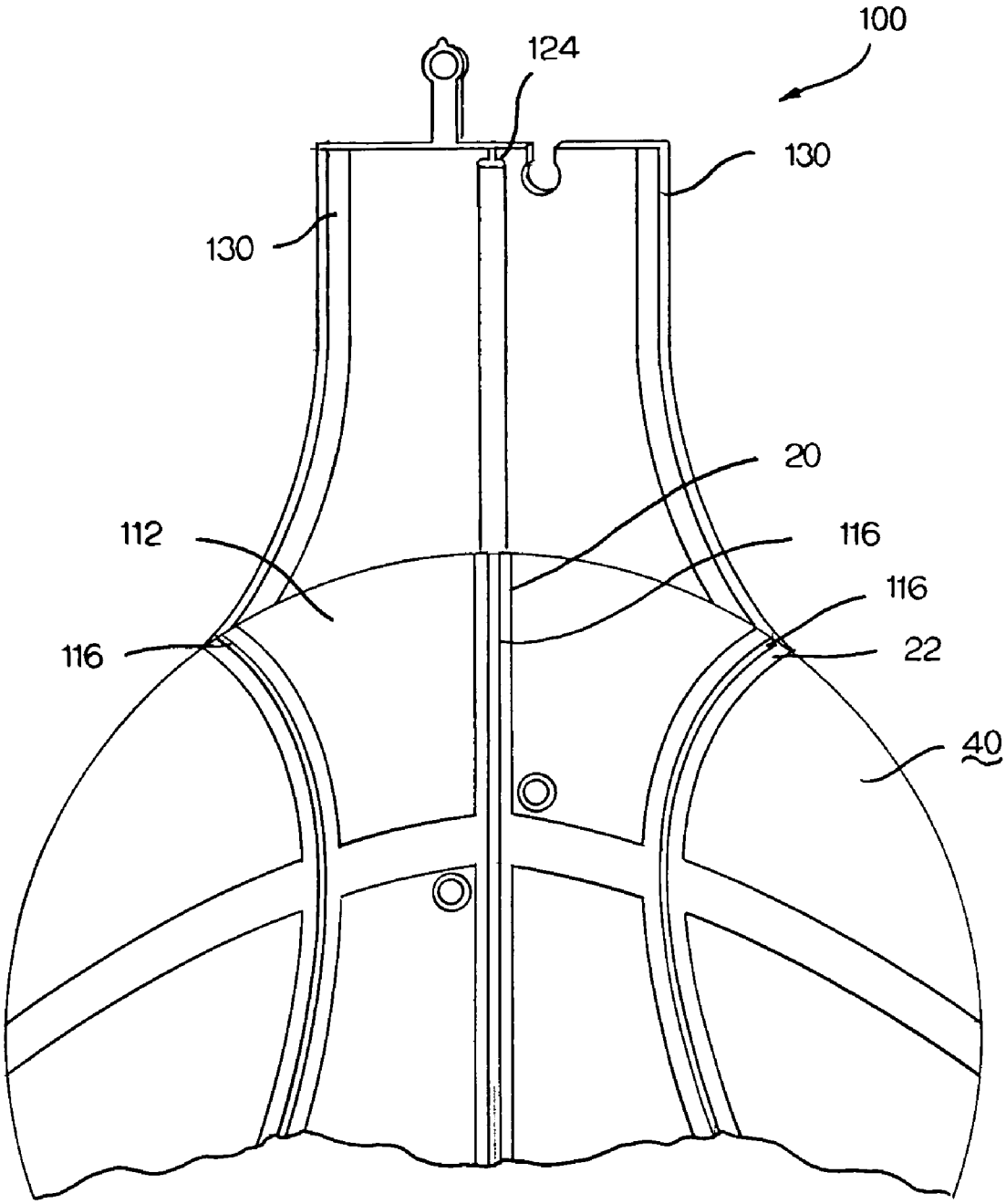
FIG. 7 is a partial perspective view of an alternate embodiment of the basketball.
Figure 8:
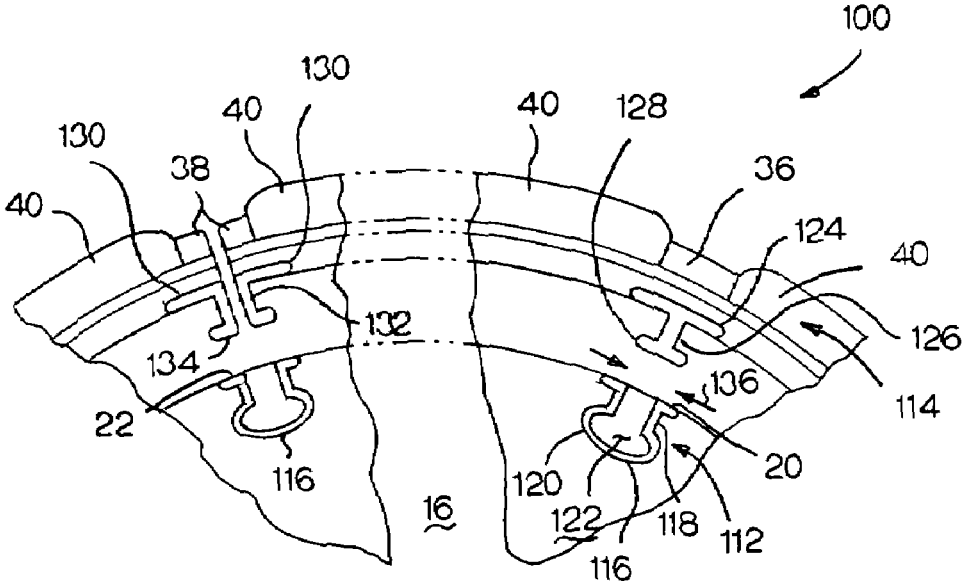
FIG. 8 is a partial explode side sectional view of the ball shown in FIG. 7 showing the cover separate from the inner ball.

Referring now to FIGS. 7 and 8 an alternative embodiment of the invention is shown. In this embodiment, ball 100 is substantially the same as ball 10, but the fasteners 26, 46 described above are replaced with complementary tongue-and-groove style fasteners. Particularly, the inner ball 112 includes a plurality of grooves or slots 116 that run along the seams 20, 22. These grooves 116 include a neck 118 that projects radially into the bladder 16 of the inner ball 112. Neck 118 terminates into a generally C-shaped slot 120 that encloses an enlarged opening 122. As shown, opening 122 is larger than the opening defined by neck 118. Neck 118 and slot 120 cooperate to define an inverted T-shaped slot.

The shell 114 includes a plurality of elongated "tongue" strips 124 that are sized to fit within groove 116. Each strip 124 projects from the inner-most surface of the shell 114 and run along the shell 114 opposite to the exterior seam 36. The tongue-shaped strips 124 have a generally T-shaped cross-section having a radially inwardly-projecting leg 126 (i.e., when the shell 114 is wrapped around the inner ball 112). Leg 126 terminates at an end piece 128 that extends perpendicularly from leg 126 in both directions. End 128 is sized to fit within opening 122.

Similarly, the peripheral edges of shell 114 include an L-shaped strip 130 that is effectively one-half of the above-described T-shaped strip 124. That is, each strip 130 has a radially projecting leg member 132 and a perpendicular end 134 that extends away from the adjacent peripheral edge. As the shell 114 is wrapped around the inner ball 112, two adjacent leaves 34 are abut and their two strips 130 also abut. These abutting strips 130 cooperate to define a tongue member that is sized and shaped the same as tongue-shaped strip 124.

The strips 124, 130 are formed from a plastic or rubber material and are bonded to the inner surface of the shell 114 in a conventional manner.

The groove 116 is formed from a resilient, yet deformable material such as a plastic material. As shown, groove 116 projects into the air bladder 16 and when the bladder 16 is slightly deflated the rubber bladder 16 stretches to allow the neck 118 to expand slightly and the strips 124, 130 may be inserted into the groove 116. Once all of the strips 124, 130 are inserted into the complementary grooves 116, the bladder 16 can be fully inflated thereby causing air pressure to act upon the neck 118 and causing the neck to slightly deform in the direction of arrows 136, thereby locking the ends 128, and 134 within the groove 116.

Figure 9:
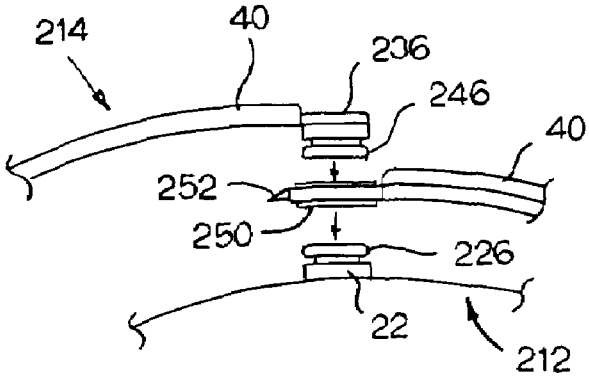
FIG. 9 is a partial exploded side sectional view of another alternate embodiment of the basketball.

Referring now to FIG. 9 an alternate embodiment of a ball 200 is illustrated where the secondary seam 22 mounted dual stud fasteners 27, 28 of ball 10 are replaced by a single fastener combination 226, 246 and a grommet 250 which fits around the male stud 226 and is held in place by female snap fastener 246. Inner ball 212 is substantially the same as inner ball 12. The shell 214 differs from shell 14 in that each leaf 34 has a first peripheral side that terminates in a full-sized seam 236 which is substantially the same as seam 36. The underside of the shell 214, opposite to seam 236, has a plurality of conventional female snap fasteners 246. The opposite peripheral side of each leaf 34 terminates in a projecting tab 252 that extends beyond and overlaps the seam 236. A plurality of rings or grommets 250 is disposed within the tab 252 and is sized to fit over the male stud 226 projecting from inner ball 212.

Figure 10:
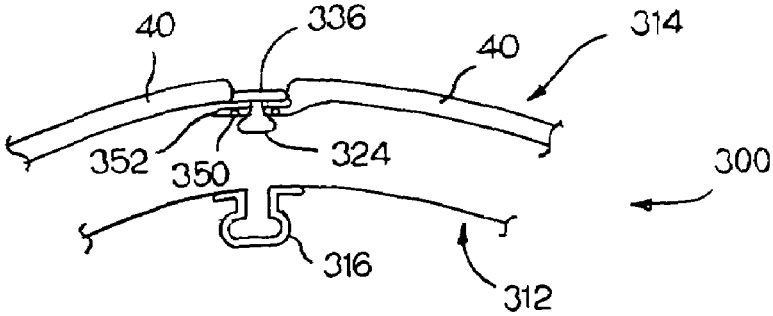
FIG. 10 is a partial exploded side sectional view of yet another alternate embodiment of the basketball.

FIG. 10 illustrates another alternate embodiment of a ball 300 which is similar in configuration to ball 200. In this embodiment, the tongue-and-groove fasteners 116, 124, 130 of ball 100 are modified to eliminate the half-tongue strips 130. The strips 130 are replaced by a single tongue-and-groove fastener combination 316, 324 and a grommet 350 which fits around the tongue-shaped strip 324 and is held in place by groove 316.

Inner ball 312 is substantially the same as inner ball 112. The shell 314 differs from shell 114 in that each leaf 34 has a first peripheral side that terminates in a full-sized seam 336 which is substantially the same as seam 36. The underside of the shell 314, opposite to seam 336, has a tongue-shaped fastener 324 that is identical to fastener 124 described above. The opposite peripheral side of each leaf 34 terminates in a projecting tab 352 that extends beyond and overlaps the seam 336. A ring or grommet 350 is disposed within the tab 352 and is sized to fit around the neck portion of the fastener 324.

It should be appreciated that strips 324 do not extend across the entire length of the seams 336. Instead a plurality of smaller strips 324 are used to allow the grommet 350 and tab 352 to surround the shorter tongue-shaped strips 324.

Figure 11:
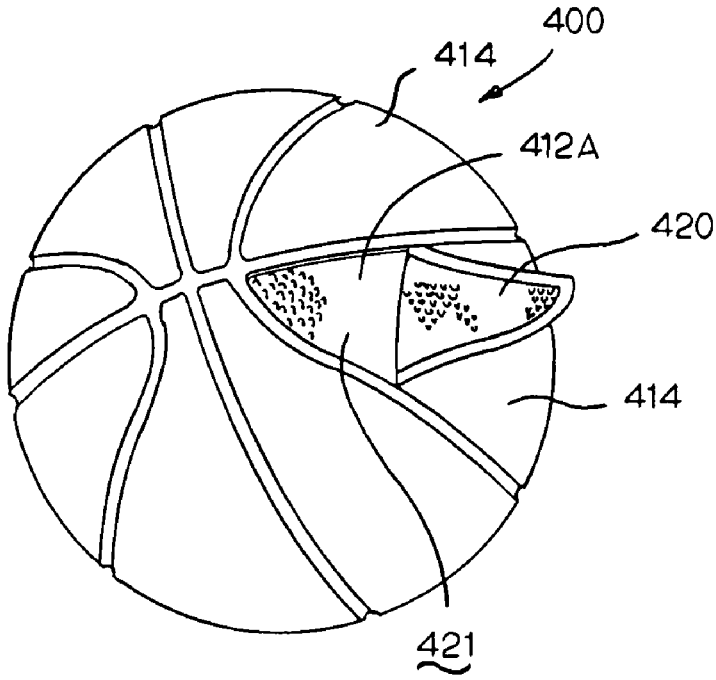
FIG. 11 is a perspective view of still another alternate embodiment of the basketball having individual removable panels coupled to an inner ball.

FIG. 11 illustrates another embodiment of a ball 400 in which the outer shell 14 is replaced by a plurality of removable panels 414. These panels 414 are sized and shaped approximately equal to the panels 40. In this manner, ball 400 includes eight panels 414 that cover of the entire inner ball.

As shown in FIGS. 11-15, the panels 414-418 may be coupled to the inner ball 412A-412E using any of the above-described fastening means. FIG. 11 illustrates an individual panel 414 having loop fasteners 420. Loop fasteners 420 cooperate with hook fasteners 421 to couple the panels 414 to the inner ball 412A.

Figure 12:
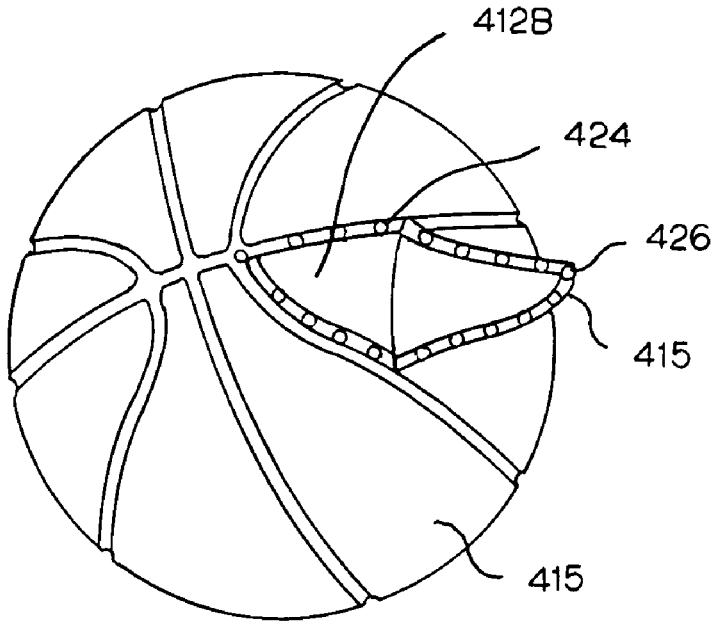
FIG. 12 is a perspective view of an alternate embodiment of the basketball shown in FIG. 11.

FIG. 12 illustrates an individual panel 415 having conventional snap fasteners 422 along its periphery. These snap fasteners cooperate with snap fasteners 424 coupled to the inner ball 412B in substantially the same manner as described above with respect to ball 10.

Figure 13:
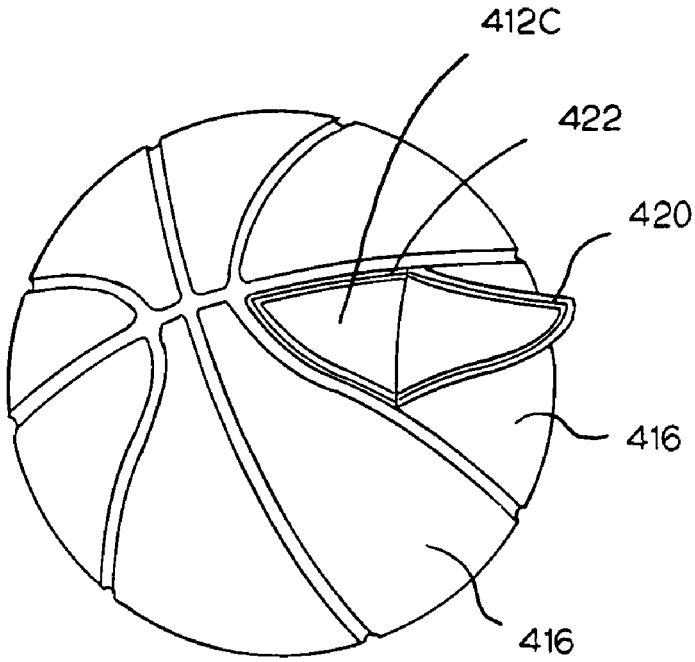
FIG. 13 is a perspective view of another alternate embodiment of the basketball shown in FIG. 11.

FIG. 13 illustrates an individual panel 416 having tongue-type fasteners 420 along its periphery. Fasteners 420 cooperate with a grooves 422 formed in inner ball 412C in substantially the same manner as described above with respect to ball 100.

Figure 14:
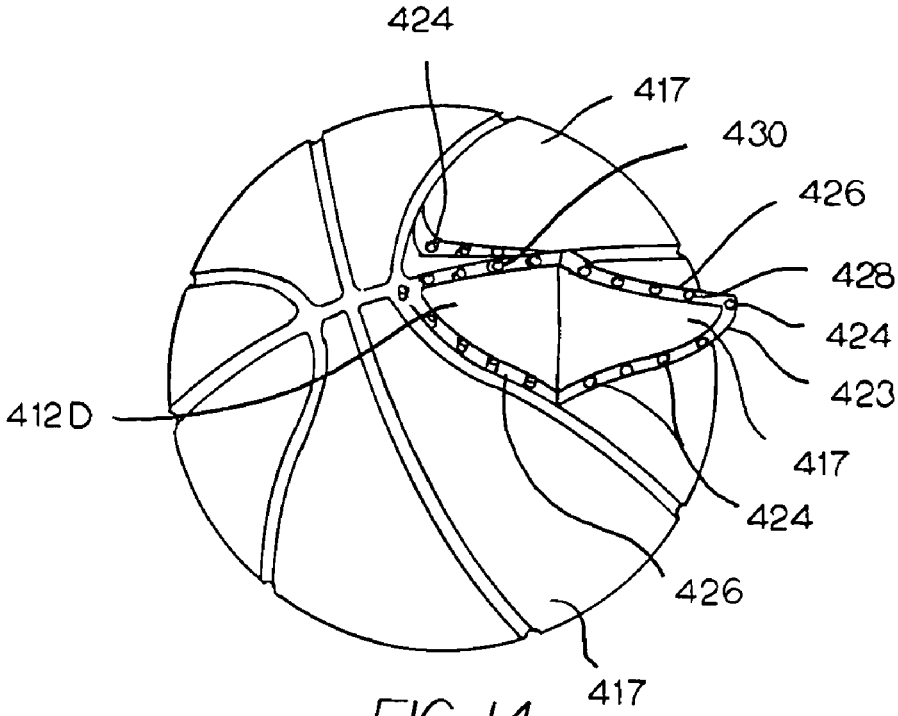
FIG. 14 is a perspective view of yet another alternate embodiment of the basketball shown in FIG. 11.

FIG. 14 illustrates an individual panel 417 having one peripheral end having a full sized seam 423 and a female snap 424 mounted opposite thereof and a second peripheral end having an extended tab 426 and a plurality of grommets 428 disposed along the tab 426. The grommets 428 fit over the studs 430 of inner ball 412D and snaps 424 couple the panel 417 to the inner ball 412D in substantially the same manner as described above with respect to ball 200.

Figure 15:
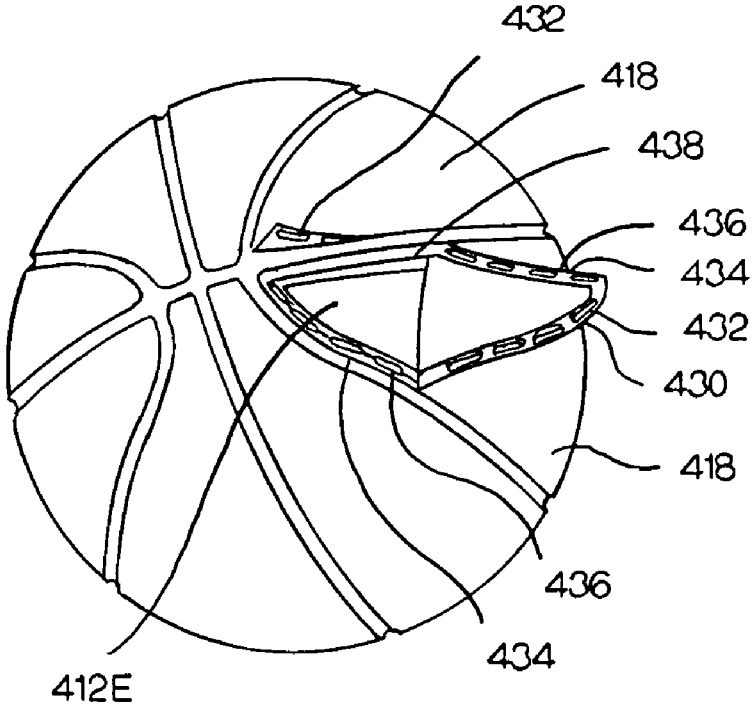
FIG. 15 is a perspective view of still another alternate embodiment of the basketball shown in FIG. 11.

Similarly, FIG. 15 illustrates an individual panel 418 having one peripheral end 430 having a full sized seam and a number of tongue-shaped fasteners 432 mounted opposite thereof and a second peripheral end having an extended tab 434 and a plurality of grommets 436. The grommets 436 fit over the tongue-shaped strips 432 on an adjacent panel 418 and the tongue-shaped fasteners 432 are received within grooves 438 formed in the inner ball 412E in substantially the same manner as described above with respect to ball 300.

Figure 16:
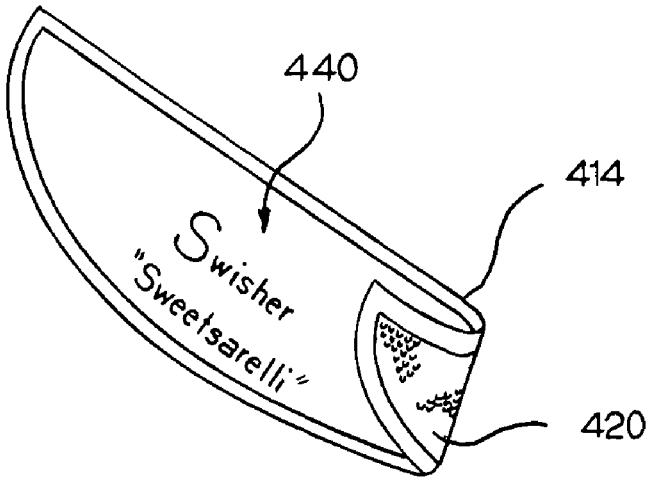
FIG. 16 is a perspective view of an a customized individual panel.

As shown in FIG. 16, the smaller size of the individual panels 414-418 allow mixing of panels having different coloration or having individualized indicia 440 thereon to allow a user to customize the appearance of his ball. In one embodiment, a panel, such as panel 414, may have indicia 440 or artwork imprinted thereon.

It should be appreciated that any of the above-described means for fastening the shell or panels to the inner ball can be used in cooperation with each other or place of one another. Particularly, the hook-and-loop fasteners may be included with any of ball having seam mounted fasteners.

In other embodiments, the inflation valve 16 may be disposed along one of the seams 20, 22, or may be centered within one of the retention wells 32. Alternatively, the inflation valve 16 may be replaced with a self-contained air pump such as that described in U.S. Pat. No. 6,287,225 issued to Daniel P. Touhey et al.

The invention has been described in an illustrative manner, and it is to be understood that the terminology, which has been used, is intended to be in the nature of words of description rather than of limitation.

Many modification and variations of the present invention are possible in light of the above teachings. It is, therefore, to be understood that within the scope of the appended claims, the invention may be practiced other than as specifically described Having described our invention, we claim:

1. A sports ball comprising:

an inflatable ball;

a cover panel that has a size and shape which covers the entire outer surface of the ball, the cover panel having a first edge and a second edge that are on opposing sides of the cover panel, the first edge including a tab that projects from the first edge and the second edge including a tab mating insertion area, wherein these edges abut and the tab is received within the tab mating insertion area when the cover panel is wrapped around the ball;

wherein the tab includes a plug that extends perpendicularly from the inner surface and in which the ball includes a port that projects down into the ball and which is sized to receive and frictionally retain the plug; and attachment means for removably coupling the cover panel to the outer surface of the ball.

2. A sports ball as defined in claim 1, wherein the cover panel is one contiguous piece shaped as four perpendicular leaves.

3. A sports ball as defined in claim 1, wherein the attachment means includes complementary hook and loop fasteners.

4. A sports ball as defined in claim 1, wherein the attachment means includes a plurality of interlocking snap fasteners.

5. A sports ball as defined in claim 4, in which each snap fastener comprises a stud and a socket and wherein some of the sockets are coupled to an inner surface of the cover panel along its periphery and the studs are coupled to the outer surface of the ball.

6. A sports ball comprising:

an inflatable inner ball having an outer surface and includes raised seams that circumscribe the outer surface;

a cover having an interior surface, the cover is wrapped around the inner ball and completely covers the outer surface of the inner ball; and complementary fasteners which are mounted to said outer surface and said inner surface to removably couple the cover to the inner ball, wherein the fasteners mounted to the inner surface of the cover are adjacent to and run along the periphery of the cover.

7. A sports ball as defined in claim 6 in which the fasteners coupled to the outer surface of the inner ball are disposed on the seams.

8. A sports ball as defined in claim 6 in which the inner ball includes a pair of retention wells that are disposed proximate to each other and in which the cover includes a pair of tabs, each of the tabs having a cylindrical plug that frictionally fits within one of the retention wells.

9. A sports ball as defined in claim 6 in which the cover is formed from four leaves that are interconnected at a center point.

10. A sports ball comprising:

an inflatable inner ball having an outer surface, the inner ball including a pair of retention wells that are disposed proximate to each other;

a cover having an interior surface, the cover is wrapped around the inner ball and completely covers the outer surface of the inner ball, wherein the cover includes a pair of tabs, each of the tabs having a cylindrical plug that frictionally fits within one of the retention wells; and complementary fasteners which are mounted to said outer surface and said inner surface to removably couple the cover to the inner ball, wherein the fasteners mounted to the inner surface of the cover are adjacent to and run along the periphery of the cover.

11. A sports ball as defined in claim 10, wherein the inner ball includes raised seams that circumscribe the outer surface of the inner ball and in which the fasteners coupled to the outer surface of the inner ball are disposed on the seams.

12. A sports ball as defined in claim 10 in which the cover is formed from four leaves that are interconnected at a center point.

* * * * *